US009494370B2

(12) United States Patent
Schreir-Alt et al.

(10) Patent No.: US 9,494,370 B2
(45) Date of Patent: Nov. 15, 2016

(54) HOMOGENEOUS LIQUID COOLING OF LED ARRAY

(75) Inventors: Thomas Schreir-Alt, Munich (DE); Katja Heumann, Russelsheim Am Main (DE); Siegmund Kobilke, Ingolstadt (DE); Michel Kazempoor, Munich (DE); Alfred Thimm, Wunsiedel (DE)

(73) Assignee: GeramTec GmbH, Plochingen (DE)

( * ) Notice: Subject to any disclaimer, the term of this patent is extended or adjusted under 35 U.S.C. 154(b) by 1047 days.

(21) Appl. No.: 12/964,634

(22) Filed: Dec. 9, 2010

(65) Prior Publication Data

US 2012/0145355 A1 Jun. 14, 2012

(51) Int. Cl.
*F28F 3/12* (2006.01)

(52) U.S. Cl.
CPC ..... *F28F 3/12* (2013.01); *F28F 2210/00* (2013.01)

(58) Field of Classification Search
CPC ..... H05K 7/20254; F28F 3/12; F28F 3/06; F28F 3/048; H01L 23/473; H01L 23/4735
USPC ..... 165/80.4, 104.33, 170; 361/699, 702; 257/714
See application file for complete search history.

(56) References Cited

U.S. PATENT DOCUMENTS

| | | | | |
|---|---|---|---|---|
| 4,561,040 | A * | 12/1985 | Eastman et al. | 361/699 |
| 5,263,536 | A * | 11/1993 | Hulburd et al. | 165/80.4 |
| 5,841,634 | A | 11/1998 | Visser | |
| 6,105,373 | A * | 8/2000 | Watanabe et al. | 62/3.7 |
| 6,152,215 | A * | 11/2000 | Niggemann | 165/166 |
| 6,366,462 | B1 * | 4/2002 | Chu et al. | 361/699 |
| 6,422,307 | B1 | 7/2002 | Bhatti et al. | |
| 6,434,003 | B1 | 8/2002 | Roy et al. | |
| 7,269,011 | B2 | 9/2007 | Bhatti et al. | |
| 7,414,843 | B2 * | 8/2008 | Joshi et al. | 361/699 |
| 7,537,047 | B2 * | 5/2009 | Lai et al. | 165/80.4 |
| 8,077,460 | B1 * | 12/2011 | Dede et al. | 361/699 |
| 8,243,451 | B2 * | 8/2012 | Dede et al. | 361/702 |
| 2005/0257917 | A1 * | 11/2005 | East et al. | 165/104.26 |
| 2006/0250774 | A1 * | 11/2006 | Campbell et al. | 361/699 |
| 2008/0029251 | A1 | 2/2008 | Nakajima et al. | |
| 2009/0095959 | A1 * | 4/2009 | Lai et al. | 257/79 |

FOREIGN PATENT DOCUMENTS

| | | | |
|---|---|---|---|
| DE | 20208106 | U1 | 10/2002 |
| WO | 2004042313 | A1 | 5/2004 |

* cited by examiner

*Primary Examiner* — Tho V Duong
(74) *Attorney, Agent, or Firm* — Norton Rose Fulbright US LLP

(57) ABSTRACT

A liquid-cooled heat sink includes a top plate having an array of circuitous liquid channels, each channel having a separate channel inlet and a common central outlet channel. The heat sink further includes a bottom plate having an inlet port and an outlet port. The heat sink further includes an intermediate plate having inlet guide channels providing fluid communication between the inlet port of the bottom plate and channel inlets of the top plate, said intermediate plate further including an outlet guide channel providing fluid communication between the common central outlet channel of the top plate and the outlet port of the bottom plate.

10 Claims, 8 Drawing Sheets

SECTION B-B

SECTION A-A

TOPSIDE (CHIP AREA)

HOMOGENEOUS LIQUID COOLING OF LED ARRAY

BACKGROUND

Field

The present invention relates generally to liquid-cooled heat sinks, and more particularly to liquid-cooled heat sinks for light emitting diode (LED) arrays.

Related Art

Semiconductor light sources, such as light-emitting diodes (LEDs), generate heat during their operation. In some high power light sources, hundreds of high power LED chips are arranged closely together in an LED array or matrix. The LEDs are attached to a substrate or ceramic body. In these high power light sources, a large amount of thermal power is dissipated. The amount of thermal power may be as high as 1000 W or greater. Since the performance and requirements of LEDs, including their brightness, color, optical output power, driving voltage, and life span, are temperature dependent, cooling the LEDs uniformly and homogeneously is advantageous, especially in high performance applications. For example, in some high performance applications, the temperature differences between the LEDs within the LED array should be less than 15 percent.

One method for cooling the LED array is to use a liquid, e.g., water, as a cooling medium. For example, as shown in FIG. 1A, a cooling liquid medium flows through a closed cooling liquid channel 110 inside the substrate or ceramic body 120 on which the LEDs (not shown in the figure) are mounted. The cooling liquid channel 110 may wind through the ceramic body 120 or branch out to different parts of the ceramic body 120 for cooling the ceramic body 120 and the LEDs mounted thereon. Because the cooling liquid medium absorbs heat from the ceramic body 120 as it enters the cooling liquid channel 110 from inlet 130 and exits through outlet 140, the temperature of the cooling liquid medium at outlet 140 is higher than that at inlet 130. Accordingly, as shown in FIG. 1B, a temperature gradient is developed across the ceramic body 120. For example, the temperature of the left-end portion 150 of the ceramic body 120 is higher than the temperature of the right-end portion 160 of the ceramic body 120. As a result, the LEDs (not shown in FIG. 1B) mounted on the ceramic body 120 have significantly different operating temperatures.

Other examples of cooling systems that have undesirable temperature gradients developed across the cooling systems include those disclosed in the U.S. Pat. No. 5,841,634 and the German patent DE 202 08 106 U1.

SUMMARY

A liquid-cooled heat sink includes a top plate having an array of circuitous liquid channels, each channel having a separate channel inlet and a common central outlet channel. The heat sink further includes a bottom plate having an inlet port and an outlet port. The heat sink further includes an intermediate plate having inlet guide channels providing fluid communication between the inlet port of the bottom plate and channel inlets of the top plate, said intermediate plate further including an outlet guide channel providing fluid communication between the common central outlet channel of the top plate and the outlet port of the bottom plate.

BRIEF DESCRIPTION OF THE FIGURES

The present application can be best understood by reference to the following description taken in conjunction with the accompanying drawing figures, in which like parts may be referred to by like numerals.

DETAILED DESCRIPTION

The following description is presented to enable a person of ordinary skill in the art to make and use the invention, and is provided in the context of particular applications and their requirements. Various modifications to the embodiments will be readily apparent to those skilled in the art, and the generic principles defined herein may be applied to other embodiments and applications without departing from the spirit and scope of the invention. Moreover, in the following description, numerous details are set forth for the purpose of explanation. However, one of ordinary skill in the art will realize that the invention might be practiced without the use of these specific details. In other instances, well-known structures and devices are shown in block diagram form in order not to obscure the description of the invention with unnecessary detail. Thus, the present invention is not intended to be limited to the embodiments shown, but is to be accorded the widest scope consistent with the principles and features disclosed herein.

While the invention is described in terms of particular examples and illustrative figures, those of ordinary skill in the art will recognize that the invention is not limited to the examples or figures described.

Figure 1A:
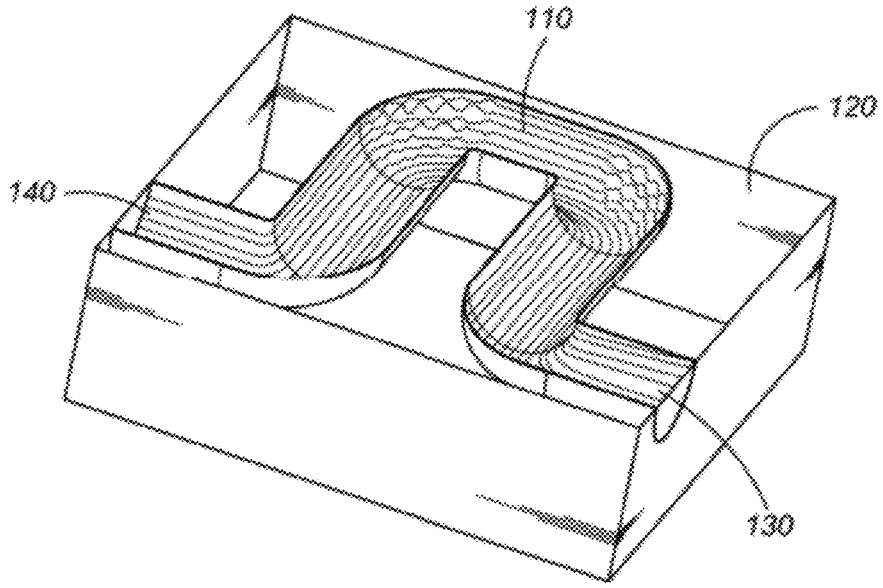
(PRIOR ART) FIG. 1A
FIG. 1A illustrates a prior art system in which a closed cooling liquid channel is embedded in a ceramic body for mounting LEDs.
Figure 1B:
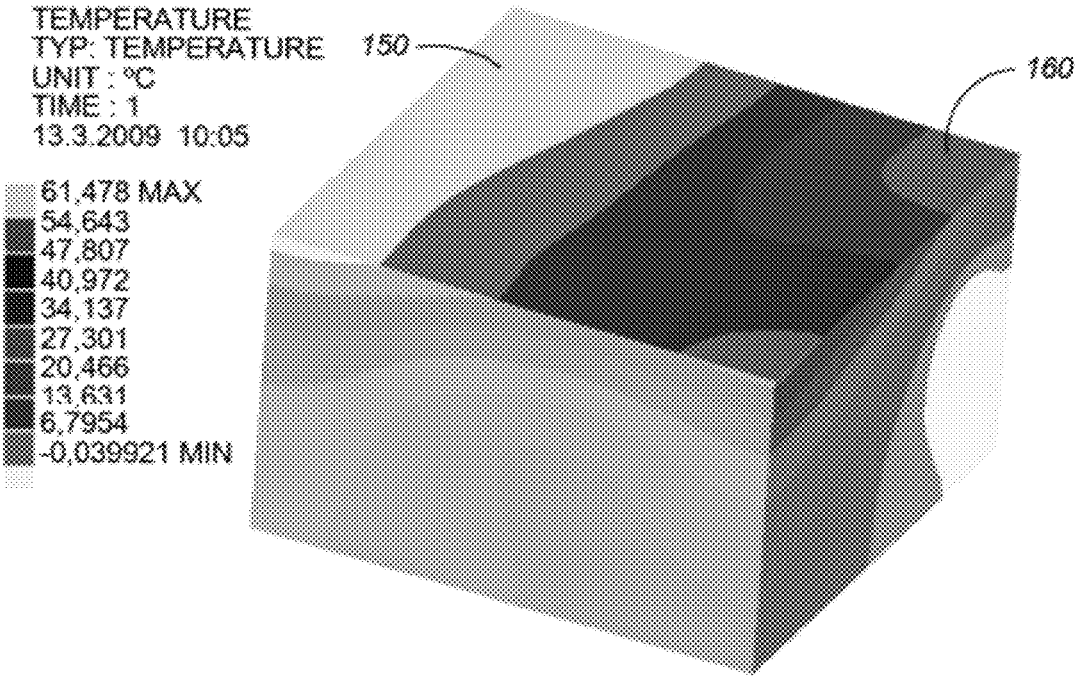
FIG. 1B illustrates the temperature gradient developed across the ceramic body shown in FIG. 1A.
Figure 2A:
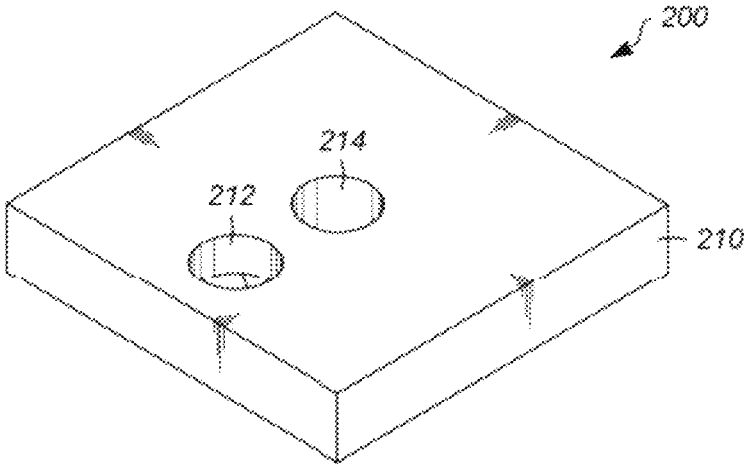
FIGS. 2A-2C illustrate a first perspective view of the three plates that may be stacked and attached together to form an exemplary liquid-cooled heat sink as shown in FIG. 4A.
Figure 2B:
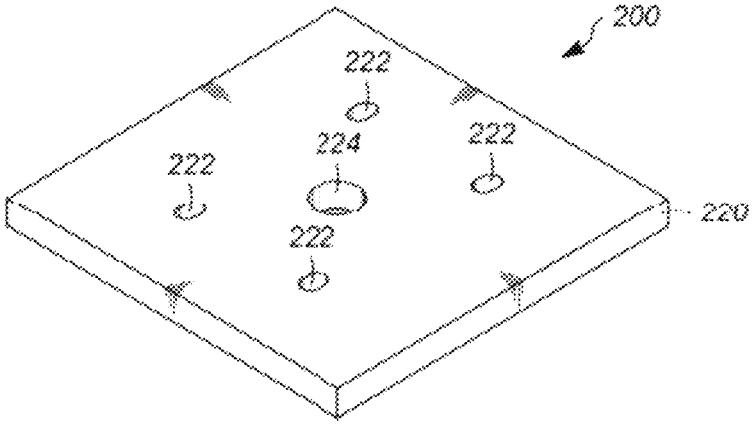
Figure 2C:
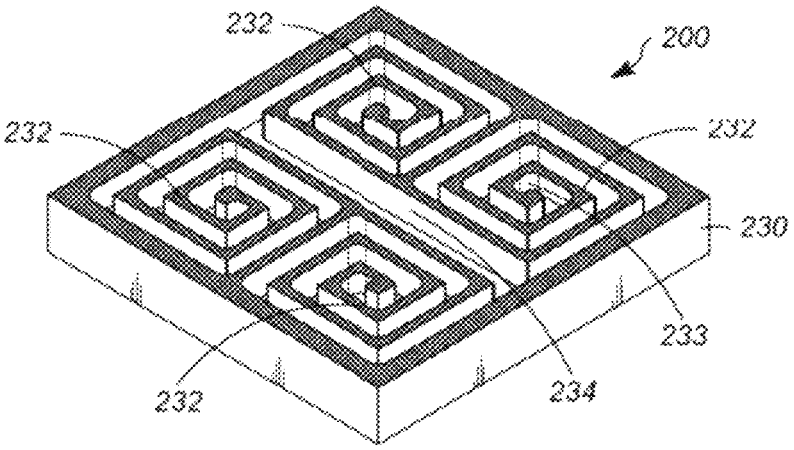
Figure 3A:
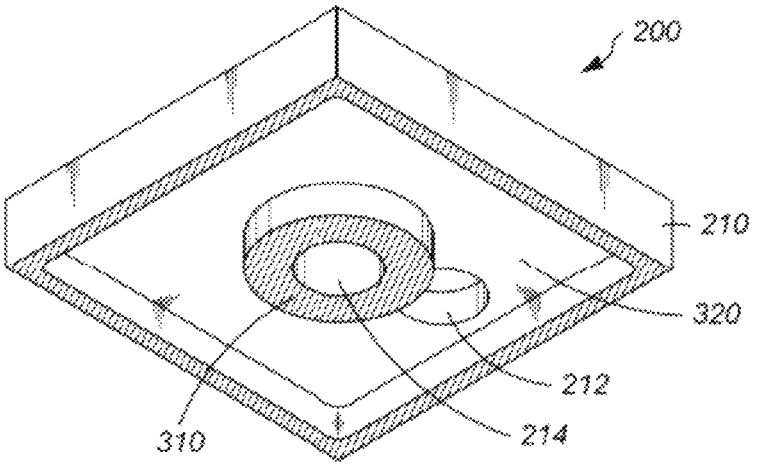
FIGS. 3A-3C illustrate a second perspective view of the three plates that may be stacked and attached together to form the exemplary liquid-cooled heat sink as shown in FIG. 4A.
Figure 3B:
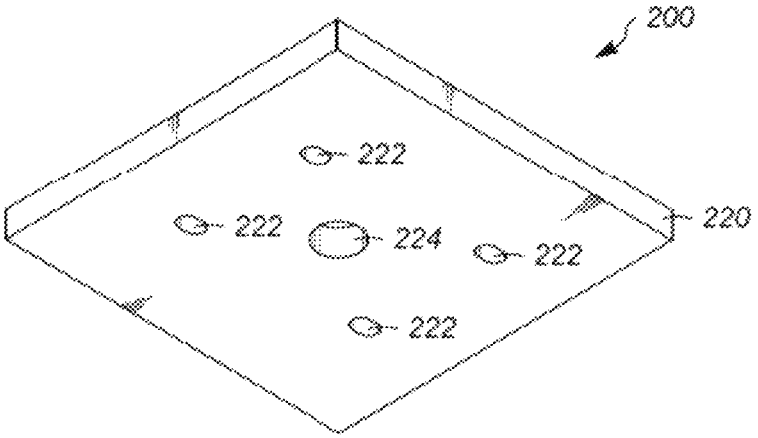
Figure 3C:
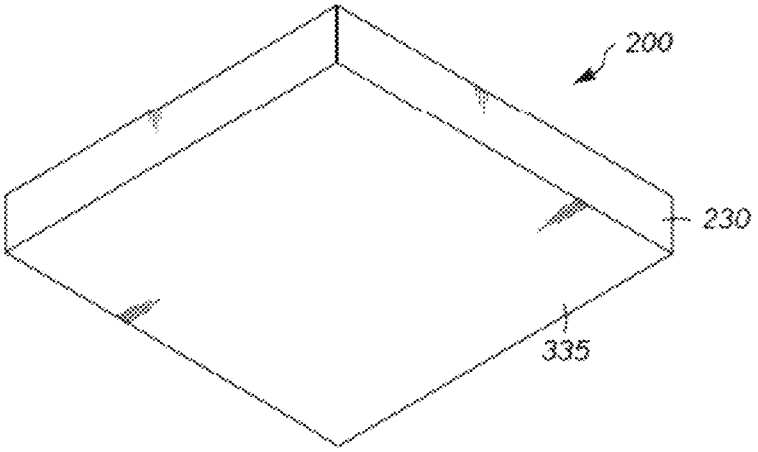
Figure 4A:
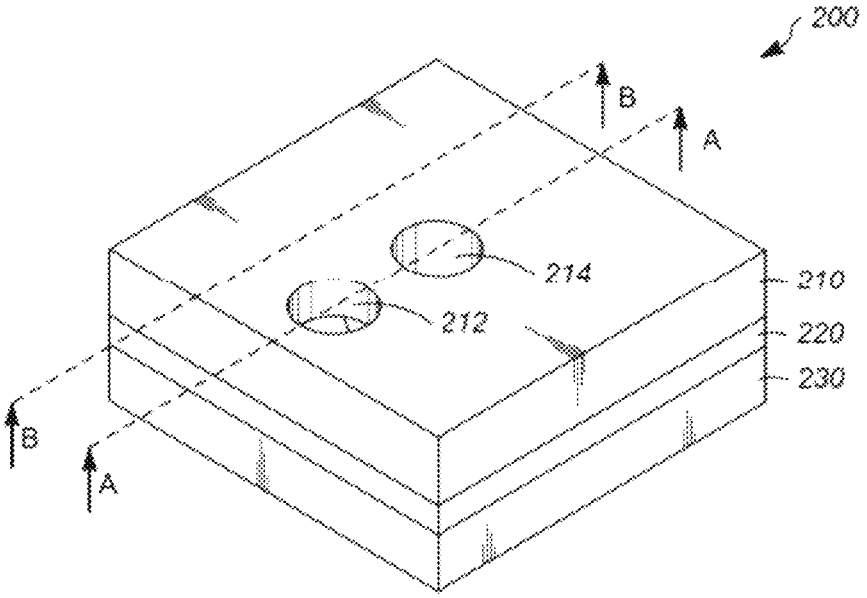
FIG. 4A illustrates a perspective view of the three plates assembled together to form an exemplary liquid-cooled heat sink in accordance with the present application.

FIGS. 2-4 illustrate the different views of an exemplary liquid-cooled heat sink 200 in accordance with the present invention. The liquid-cooled heat sink 200 comprises three plates—base plate 210, middle plate 220, and top plate 230. Note that the liquid-cooled heat sink 200 is oriented upside down in FIGS. 2-4 to better illustrate certain features of the liquid-cooled heat sink 200. As shown in FIG. 4A, the three plates 210, 220, and 230 are stacked and attached together to form the liquid-cooled heat sink 200. The base plate 210 and the middle plate 220 are stacked together to form a base layer of the liquid-cooled heat sink 200. The middle plate 220 and the top plate 230 are stacked together to form a top layer of the liquid-cooled heat sink 200. In one exemplary embodiment, plates 210, 220, and 230 are attached together with adhesive, ceramic frit, intermediate gasket material, and the like. However, it is contemplated that plates 210, 220, and 230 may be attached together with other connectors, including pins, screws, clamps, and the like. With reference to FIG. 3C, the LEDs (not shown in the figure) are mounted on the LED mounting surface 335 of plate 230. This LED mounting surface 335 is the target cooled surface and this surface should ideally have a homogenous temperature profile.

FIGS. 2A-2C illustrate a perspective view of plates 210, 220, and 230. In this orientation, the LED mounting surface 335 of plate 230 is facing down, and four circuitous cooling channels 232 are exposed to view in FIG. 2C.

FIGS. 3A-3C illustrate a perspective view of plates 210, 220, and 230 in a second orientation. In this orientation, the LED mounting surface 335 of plate 230 is exposed to view in FIG. 3C.

Figure 4B:
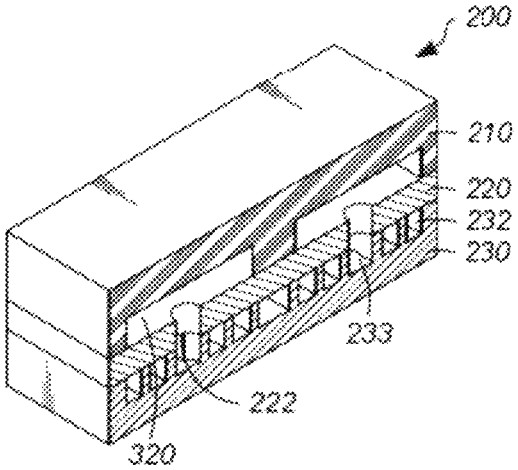
FIG. 4B illustrates a cross-sectional view along plane B-B in FIG. 4A.
Figure 4C:
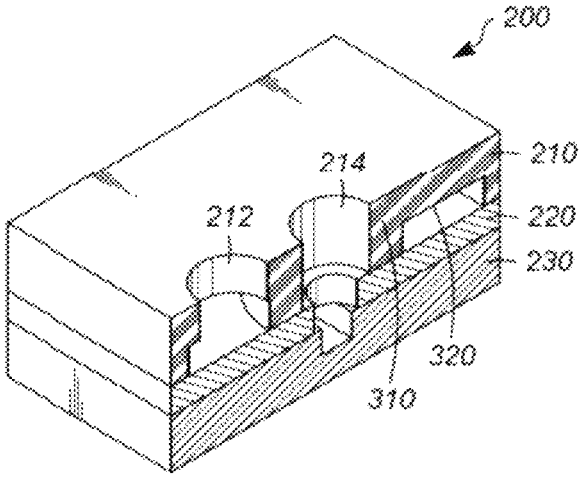
FIG. 4C illustrates a cross-sectional view along plane A-A in FIG. 4A.

FIG. 4A illustrates a perspective view of plates 210, 220, and 230 assembled together. The cross-sectional view along plane A-A in FIG. 4A is shown in FIG. 4C. The cross-sectional view along plane B-B in FIG. 4A is shown in FIG. 4B.

Plate 210 is the plate that is located furthest away from the LED mounting surface 335 of plate 230. As shown in FIGS. 2A and 3A, plate 210 has a tray-like shape and has two openings. The opening located in a radially outer position is an inlet 212 directing liquid into the liquid-cooled heat sink 200. The central opening is an outlet 214 directing liquid out of the liquid-cooled heat sink 200. However, it should be recognized that once the liquid enters the liquid-cooled heated sink 200 through inlet 212, the liquid does not exit the liquid-cooled heat sink 200 immediately through the outlet 214. The liquid cannot exit immediately through the outlet 214 because a cylindrical wall 310 (see FIG. 3A) surrounding the outlet 214 is flush against plate 220 (see FIG. 4C) when the plates are assembled. Instead, the liquid flows within a channel 320 (see FIGS. 3A and 4C) formed between plates 210 and 220. The channel 320 is a space between the rim of the tray-like base plate 210 and the cylindrical wall 310. The channel 320 steers the liquid through four inlets 222 on plate 220 and into four circuitous cooling channels 232 (see FIG. 2C), respectively.

The circuitous cooling channels 232 direct the liquid to absorb heat from the LED mounting surface 335 of plate 230. As shown in FIG. 2C, each of the circuitous cooling channels 232 directs the liquid from a central point 233 of the channel 232 and progressively farther away as the channel 232 revolves around the central point 233 in a spiral-like configuration. The liquid is then directed by the circuitous cooling channels 232 to the central point 234 of plate 230. The liquid then exits the liquid-cooled heat sink 200 via a heat sink outlet. The heat sink outlet is formed by aligning outlet 224 on plate 220 with outlet 214 on plate 210 when the plates are stacked together.

In the exemplary embodiment disclosed above, the circuitous cooling channels 232 are shaped like spirals. As shown in FIG. 2C, the circuitous path traced by the liquid in a circuitous cooling channel is defined by walls perpendicular to the LED mounting surface 335. The circuitous cooling channels 232 facilitate a fast flow of the liquid. However, it is contemplated that the circuitous cooling channels 232 may distribute the liquid to different portions of plate 230 and then back to the central point 234 of plate 230 in other configurations.

Figure 5:
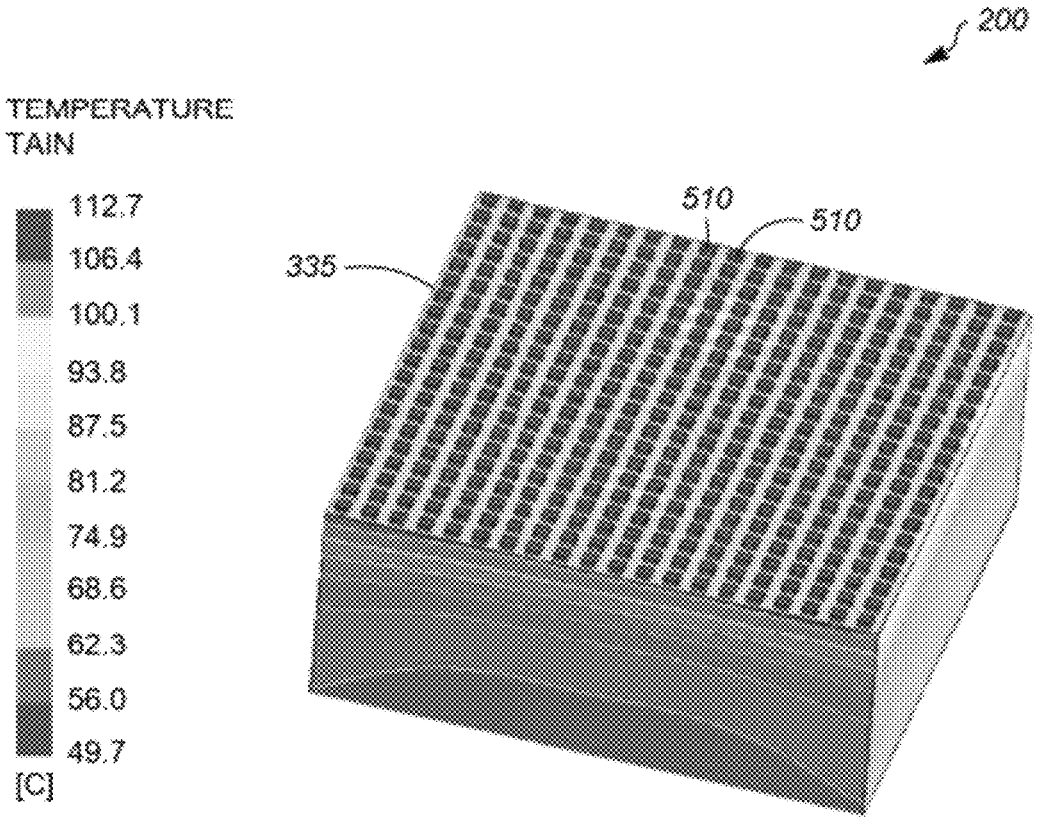
FIG. 5 illustrates a temperature profile of the exemplary liquid-cooled heat sink as shown in FIG. 4A.

FIG. 5 illustrates a temperature profile of the exemplary liquid-cooled heat sink as shown in FIG. 4A. An LED array with 20×20 LEDs 510 is shown on top of the LED mounting surface 335. The temperature variation on the LED mounting surface 335 is less than 15 percent. For example, the LEDs along the edges of the LED mounting surface 335 do not have much higher temperatures than those in other areas.

Figure 6A:
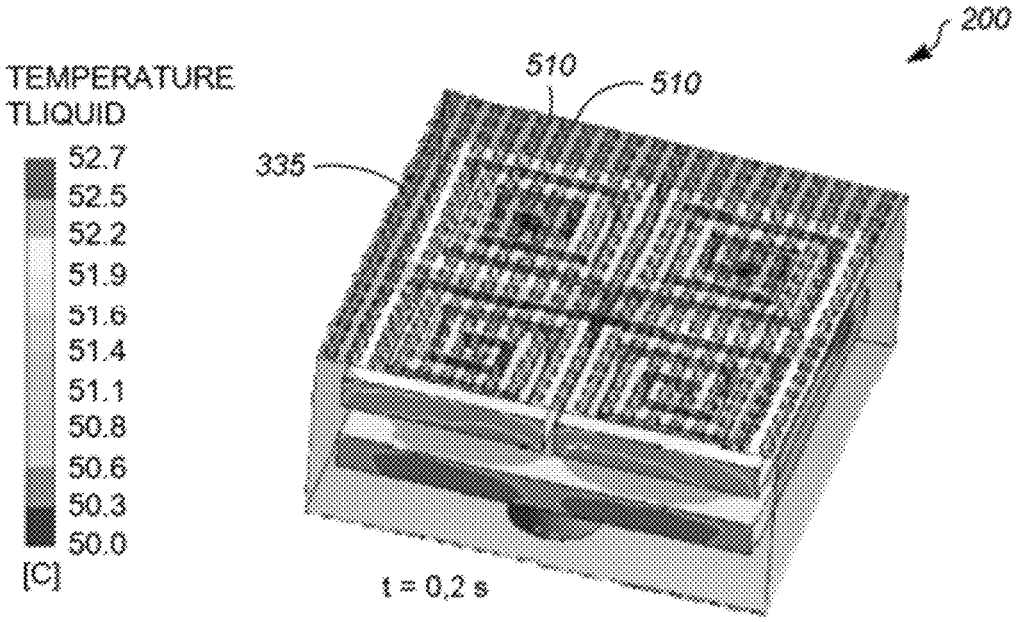
FIGS. 6A and 6B illustrate the temperature profile of the exemplary liquid-cooled heat sink as shown in FIG. 4A at t=0.2 second and t=5 seconds, respectively.
Figure 6B:
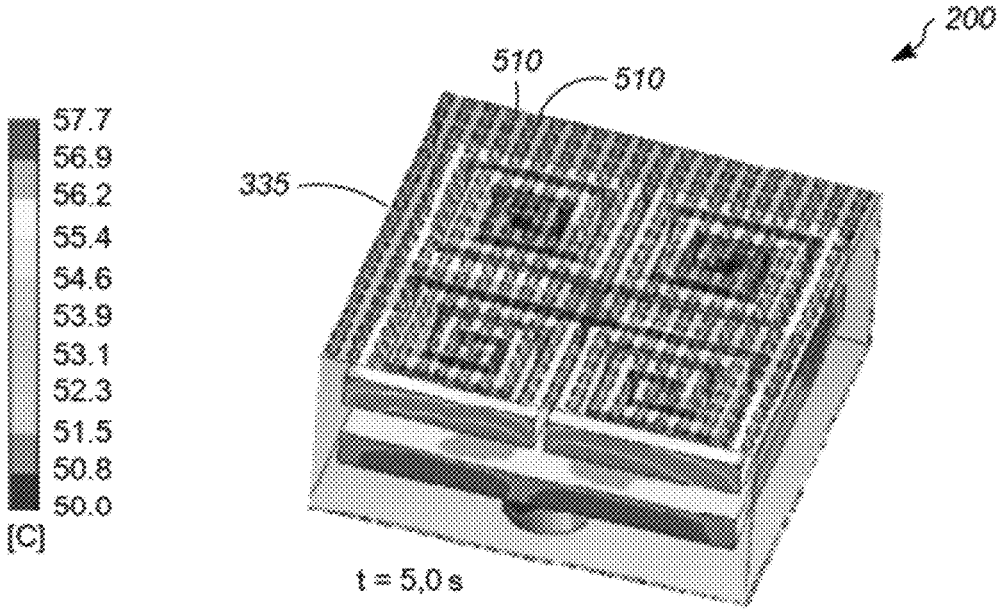

FIGS. 6A and 6B illustrate the temperature profile of the exemplary liquid-cooled heat sink as shown in FIG. 4A at t=0.2 second and t=5 seconds, respectively. The time t is the time after the LEDs are turned on. The cooling system is running at the start of the measurement.

The exemplary multilayer liquid-cooled heat sink described above can achieve homogenous cooling of the LEDs for several reasons. The cold liquid cooling medium does not impinge directly on the LED mounting surface. In the above example, the cold liquid is injected through four inlets 222. The injected cold liquid is brought in four channels to the LED mounting surface 335. Each of the channels spirals outward from the corresponding inlet. In this way, the liquid is distributed through an intermediate plane over the entire area of the LED mounting surface. As a result, the LED mounting surface is cooled homogenously.

In addition, each of the channels directs the heated liquid to the central outlets 224 and 214 where the heated liquid is ejected out of the liquid-cooled heat sink. This facilitates the removal of heated liquid and avoids unnecessary heating of the LEDs.

In addition to having a uniform temperature distribution, the exemplary multilayer liquid-cooled heat sink described above provides a good thermal connection between the cooling liquid medium and the ceramic body due to the long liquid flow paths. The parallel connection of the circuitous channels decreases the pressure loss in the cooling liquid medium. As a result, less pumping power is required. Another advantage is that the liquid supply line comes from underneath. As a result, scalability of the module to larger array geometries is possible. For example, the LED mounting area can be expanded without difficulty.

Plates 210, 220, and 230 forming the liquid-cooled heat sink 200 may be formed of any appropriate material, including dry-formed ceramics and different types of substrates. For example, the plates may be formed of aluminum nitrite (AIN) ceramic, which is non-electrically conductive and thermally conductive. In some exemplary embodiments, a ceramic material is pressed into plates using a dry-pressing process. The plates are then structured by milling. The structured plates are glued together with a ceramic paste to form the liquid-cooled heat sink 200. After the glue is dried, the liquid-cooled heat sink 200 is sintered. Alternatively, a thin layer of glass or glass ceramic may be used to combine the structured plates together.

Figure 7:
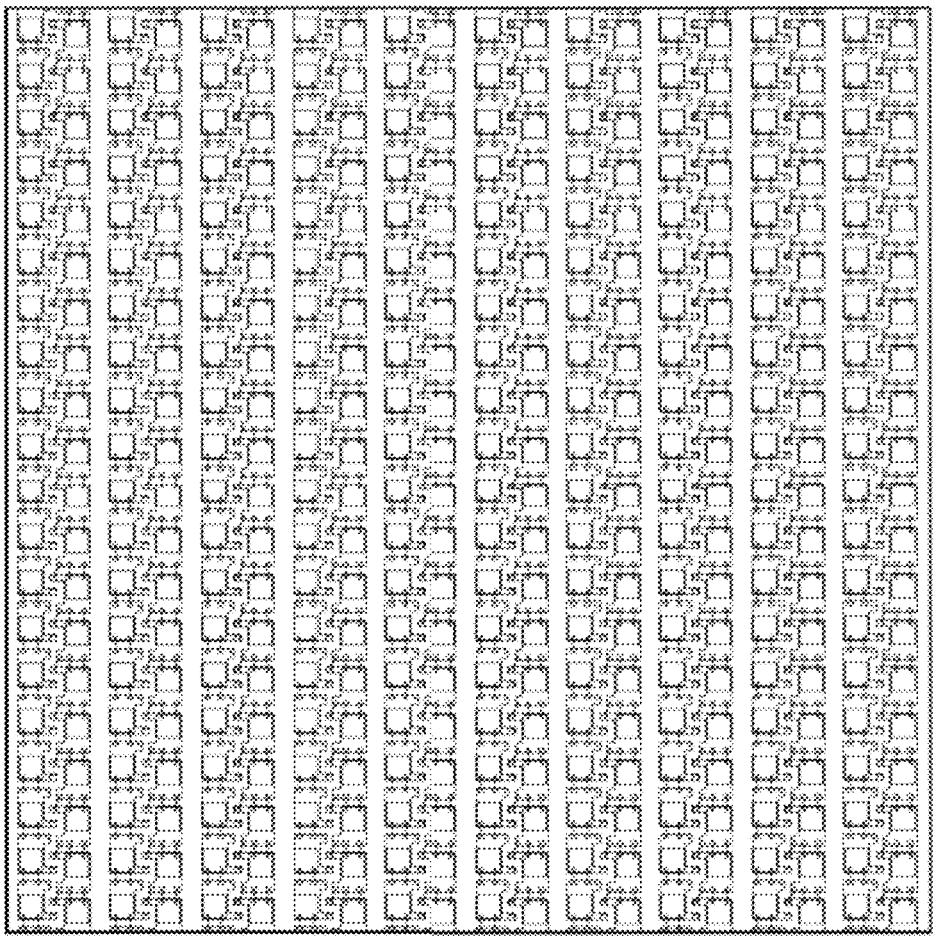
FIG. 7 illustrates an exemplary layout for mounting 20×20 LEDs onto an exemplary liquid-cooled ceramic heat sink in accordance with the present application.
Figure 8A:
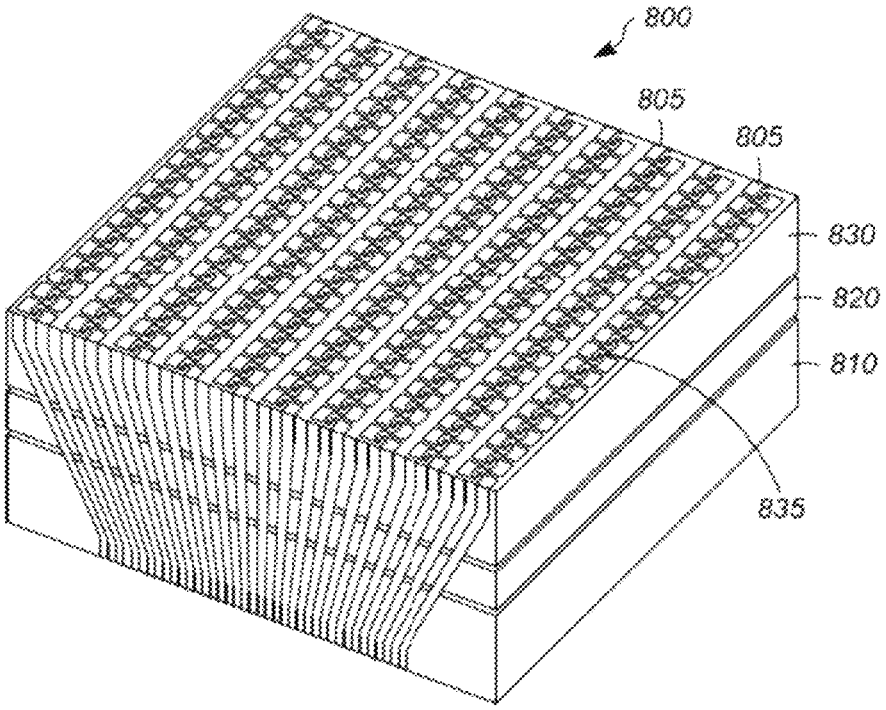
FIG. 8 illustrates an exemplary liquid-cooled heat sink 800 with metallization 805.
Figure 8B:
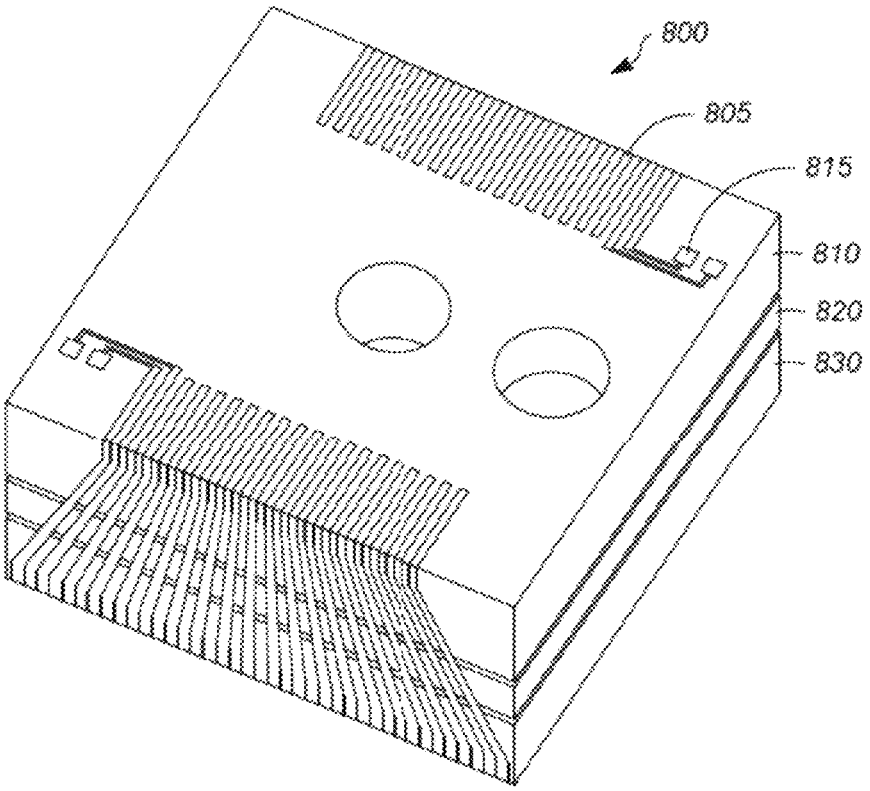

After the plates are attached together, a plurality of LEDs are then soldered on the LED mounting surface 335 by metallization, including tungsten glass or silver metallization. FIG. 7 illustrates an exemplary layout for mounting 20×20 LEDs onto an exemplary liquid-cooled ceramic heat sink in accordance with the present application. FIG. 8 illustrates an exemplary liquid-cooled heat sink 800 with metallization 805. A plurality of LEDs may be soldered onto the metallization 805 on the top plate 830. As shown in FIG. 8, metallization 805 on the top plate 830 is arranged to be parallel to the outer edges 835. Metallization 805 extends to the base plate 810 where electrical terminals 815 are provided. In order to optimize the cooling, the metallization 805 is arranged preferably only above the circuitous cooling channels 232 and not above the walls between the circuitous cooling channels 232. The metallization 805 comprises sintered metallization regions applied to the surface of the ceramic plates. These sintered metallization regions have good thermal conductivity to the non-electrically conducting plates.

A ceramic (e.g., AIN) liquid-cooled heat sink 200 with a plurality of LEDs directly attached on the LED mounting surface 335 by metallization as described above effectively removes heat from the LEDs. The ceramic body serves as a heat sink with high thermal conductivity and as a carrier for the LEDs. This eliminates the need of attaching a separate printed circuit board onto a heat sink with glue, which has poor thermal conductivity. As can be appreciated, the prior art systems that use a metal heat sink would require that a separate printed circuit be attached to the metal heat sink adding a thermal bottleneck between the metal heat sink and the circuit board.

In some exemplary embodiments, the number of circuitous cooling channels is four. However, it is contemplated that the number of circuitous cooling channels may depend on the size of the target cooled surface, the heat generated by the LEDs, the target maximum temperature differences of the LEDs, and other factors.

In some exemplary embodiments, a pump may be included to apply pressure to the cooling liquid medium. For example, the pump may inject the cooling liquid medium into inlet 212, causing the liquid to circulate through the heat sink 200 and out of outlet 214. The cooling liquid medium may be water. However, it is contemplated that other liquids that are thermally conductive may be used as well.

In some exemplary embodiments, the heat sink 200 may operate without a pump. The cooling liquid medium may be a volatile liquid, such as ethanol or chlorofluorocarbon (CFC). The cooling liquid medium evaporates when it absorbs heat from the heat sink 200. After the cooling liquid medium exits the heat sink 200, an external cooler may be used to condense the cooling liquid medium back into liquid form, which may be directed back into the heat sink 200 again.

In one preferred embodiment, plates 210, 220, and 230 are formed of AIN-4.5% $Y_2O_3$, and each has a dimension of 60*60*5 mm. The plates are pressed using a dry-pressed process. The plates are structured using a diamond milling cutter. Using a 325 mesh metal screen, a paste (70% AIN-4.5% $Y_2O_3$ and 30% screen printing oil) is printed on the base plate 210 and the top plate 230. Plates 210, 220, and 230 are then laid on top of each other within ten minutes using a fitting mound. The liquid-cooled heat sink 200 is sintered at 1,805° C. in nitrogen for five hours in a graphite furnace. The outer surfaces of the liquid-cooled heat sink 200 are grounded with diamond discs on a surface-grinding machine. Some of the outer surfaces of the liquid-cooled heat sink 200 are printed on with a silver-1% platinum paste in a strip-shaped manner, and the liquid-cooled heat sink 200 is burnt in air at 850° C. The LEDs are then soldered onto the liquid-cooled heat sink 200, and power is provided to the base plate 210. A plastic material may be glued to inlet 212 and outlet 214 on the base plate 210 for attaching a pump and a cooling liquid reservoir to the liquid-cooled heat sink 200.

As discussed above, in the preferred embodiment, the cooling fluid is circulated by directing fluid into the inlet port 212, separating the fluid via channels 222 into the center of the individual circuitous channels 232 and then removing the fluid through the central outlet 214. It is within the scope of the subject invention that fluid flow be in the opposite direction. Specifically, the device could be operated by causing the fluid to enter opening 214, so that it circulates within the circuitous channels from the outside to the inside. Thereafter, the fluid would be removed through opening 212. It is believed that this reverse flow path would provide less efficient cooling than the forward flow path.

The exemplary multilayer liquid-cooled heat sink described above may be used for cooling power electronics other than LEDs, and may be used in different applications. For example, the heat sink may be used in high power LED light sources for curing ink or glue, sterilization of liquids, and the like. The heat sink may also be used to cool large area semiconductor chips which are soldered directly onto the substrate. In this case, inhomogeneous temperature distribution would result in mechanical stress in the semiconductor chips.

Although the present invention has been described in connection with some embodiments, it is not intended to be limited to the specific form set forth herein. Rather, the scope of the present invention is limited only by the claims. Additionally, although a feature may appear to be described in connection with particular embodiments, one skilled in the art would recognize that various features of the described embodiments may be combined in accordance with the invention.

Furthermore, although individually listed, a plurality of means, elements or process steps may be implemented by, for example, a single unit or processor. Additionally, although individual features may be included in different claims, these may possibly be advantageously combined, and the inclusion in different claims does not imply that a combination of features is not feasible and/or advantageous. Also, the inclusion of a feature in one category of claims does not imply a limitation to this category, but rather the feature may be equally applicable to other claim categories, as appropriate.

What is claimed is:

1. A liquid-cooled heat sink comprising:

a base plate;

a middle plate; and a top plate;

wherein the base plate and the middle plate are stacked and attached together to form a base layer of the heat sink;

wherein the middle plate and the top plate are attached together to form a top layer of the heat sink;

wherein the surface of the top plate not facing the middle plate is a target cooled surface;

wherein the base layer has a channel distributing a liquid from a heat sink inlet on the base plate to a plurality of inlets on the middle plate, each of the plurality of inlets directing the liquid to a corresponding circuitous channel in the top layer;

wherein each of the circuitous channels directs the liquid in a circuitous path, in a plane adjacent to the target cooled surface, cooling the surface; and wherein the circuitous channels merge at an aggregation point among the circuitous channels, the aggregation point being connected to a heat sink outlet directing the liquid from the top layer back to the base layer and out of the heat sink, wherein the top plate, the middle plate, and the base plate are formed of ceramic, wherein the channel steers the liquid through four inlets on the plate and into four circuitous cooling channels, wherein each of the circuitous cooling channels directs the liquid from a central point of the channel of the base plate layer and progressively farther away as the channel revolves around the central point in a spiral configuration, and then the liquid is directed by the circuitous cooling channels to the central point of the top plate and the liquid then exits the liquid-cooled heat sink via a heat sink outlet, wherein the heat sink outlet is formed by aligning the outlet on the base plate with an outlet on additional plate when the base plate and the additional plate are stacked together.

2. The liquid-cooled heat sink of claim 1, wherein the circuitous cooling channels are shaped like spirals and the circuitous path traced by the liquid in the circuitous cooling channel is defined by walls perpendicular to the target cooled surface.

3. The liquid-cooled heat sink of claim 1, wherein each of the circuitous paths is defined by walls perpendicular to the target cooled surface.

4. The liquid-cooled heat sink of claim 1, the middle plate further comprising a middle plate opening aligned with the second base plate opening to form the heat sink outlet.

5. The liquid-cooled heat sink of claim 1, the base plate further comprising a wall perpendicular to the base plate and surrounding the second base plate opening, the wall being flush against the middle plate when the base plate and the middle plate are attached together, thereby preventing the liquid from flowing from the chamber inside the base layer to the second base plate opening.

6. The liquid-cooled heat sink of claim 1, wherein the channel inside the base layer is defined by the rim of the base plate and the wall.

7. The liquid-cooled heat sink of claim 1, wherein the number of circuitous channels is at least four.

8. The liquid-cooled heat sink of claim 7, wherein the circuitous channels are laid out in a two by two array.

9. The liquid-cooled heat sink of claim 1, wherein the top plate is formed of ceramic.

10. The liquid-cooled heat sink of claim 1, wherein the top plate, the middle plate, and the base plate are formed of ceramic.

* * * * *